US005315796A

United States Patent [19]

Gruhlke

[11] Patent Number: 5,315,796

[45] Date of Patent: May 31, 1994

[54] PROTECTIVE SLEEVE FOR POSTS IN POST FRAME CONSTRUCTION

[76] Inventor: David Gruhlke, 26740 Hwy. 169, Zimmerman, Minn. 55398

[21] Appl. No.: 64,210

[22] Filed: May 21, 1993

[51] Int. Cl.[5] ..... E02D 31/02; E02D 31/06

[52] U.S. Cl. ..... 52/170; 52/169.13; 52/728

[58] Field of Search ..... 52/170, 298, 720, 727, 52/728, 169.13

[56] References Cited

U.S. PATENT DOCUMENTS

| | | | |
|---|---|---|---|
| 646,970 | 4/1900 | Francis | 52/170 |
| 725,820 | 4/1903 | Beazley | 52/170 |
| 1,230,475 | 6/1917 | Gardner | 52/727 |
| 1,735,722 | 11/1929 | Beard . | |
| 2,724,156 | 11/1955 | Shaw | 52/170 |
| 4,244,156 | 1/1981 | Watts, Jr. | 52/746 |
| 4,799,340 | 1/1989 | Lichan et al. | 52/170 |
| 5,090,165 | 2/1992 | Kenny | 52/298 X |
| 5,138,806 | 8/1992 | Mars | 52/170 |

FOREIGN PATENT DOCUMENTS

| | | | |
|---|---|---|---|
| 24494 | of 1883 | Fed. Rep. of Germany | 52/298 |
| 2222764 | 11/1973 | Fed. Rep. of Germany | 52/170 |

*Primary Examiner*—Carl D. Friedman
*Assistant Examiner*—Kevin Wilkens

[57] ABSTRACT

A post frame building utilizing wood support posts having bottom portion of the posts sunken into the ground. An encapsulating sleeve for each underground portion of the posts providing a positive barrier against deterioration by ground contact. The sleeve may be trimmed at ground level or higher as desired.

1 Claim, 1 Drawing Sheet

PROTECTIVE SLEEVE FOR POSTS IN POST FRAME CONSTRUCTION

BACKGROUND OF THE INVENTION

1. Field of Invention

This invention relates to a protective sleeve for the underground portion of a wood post to serve as a barrier to prevent deterioration by ground contact.

2. Description of the Prior Art

There appears to be a widespread use of various means to protect the sunken below ground portion of wood posts.

Several treatments have been used to apply a preservative to the post. In various instances sheet material has been formed over the post to be secured thereto and in some instances shrunk onto the posts. Water tight casings with and without collars also are used to prevent deterioration both from moisture and ground contact.

It is desired to provide here a barrier for a ground inset post which is impervious to the adverse effects of ground contact.

SUMMARY OF THE INVENTION

The invention herein is particularly adapted to prevent deterioration by ground contact of the lower sunken or set in the ground portions of posts such as used in post frame construction. These posts are under cover in a dry environment whereby moisture is not present and is of no consequence.

It is a principal object here to provide as low a cost as possible for the posts set into the ground as these posts are involved in a very competitive market area.

What is provided here is a very simply made sleeve of a high density polyethylene through a moulding process. Posts used for the purpose indicated are of uniform sizes and said sleeves are moulded accordingly.

A sleeve is very simply applied by the insertion therein of a post. The bottom of the sleeve is preferably made to be thicker than the walls thereof to avoid damage through ground engagement.

A favorable dry environment is an important factor in the simplicity of the sleeve structure as it is only the avoidance of ground contact which it is being protected against.

In the event of a tight fit of the sleeve, an air pocket may develop as a post is being inserted. To avoid such an occurrence, a full height vent may be provided as along a pair of opposing walls. Said sleeves will be of a height on said posts sufficiently above ground level to avoid any contact of ground with a post.

The material of polyethylene has a useful life span for such a long period of time that it becomes very appropriate for use as indicated.

Other objects and advantages will be set forth in the following description made in connection with the accompanying drawings in which like reference numerals refer to similar parts throughout the several views.

DESCRIPTION OF A PREFERRED EMBODIMENT

Figure 1:
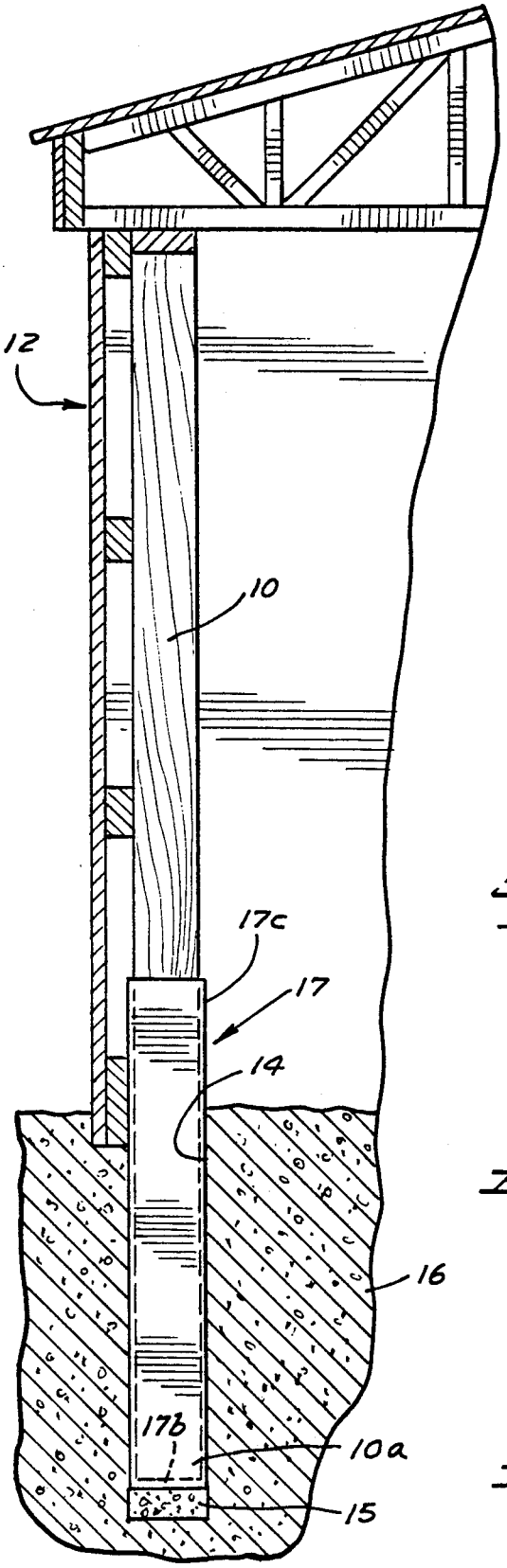
FIG. 1 is a broken view in vertical section showing the invention herein in operating position.

Referring to the Figs. and more particularly to FIG. 1, a post 10 is shown in elevation. Post 10 is typical of the posts used as vertical support columns for the erection of wood frame structures as indicated at 12 and wherein the posts are recessed inwardly sufficiently from the perimeter of said structure or are sheltered at the interior side of an adjacent wall to be in a dry environment.

The holes for the support posts are prepared as indicated at 14, all being prepared to have approximately the same depth and having at the bottom thereof a cement plate or equivalent footing as at 15.

The holes extend downwardly below the frost line which may be on the order of 42 or 48 inches to provide a secure stable footing and the post itself will rise some ten feet or more above ground level as may be required by the design of a particular structure.

The holes are back filled as at 16 and are tamped down to secure the footing.

The invention herein comprises a sleeve or casing 17 which is preferably formed moulded of a dense polyethylene plastic material which has an appropriate extensive useful life span.

Figure 2:
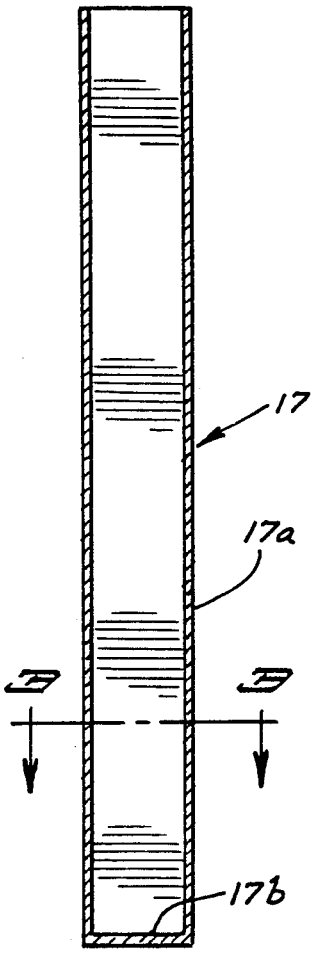
FIG. 2 is a view of the invention in vertical section.

Said sleeve or casing is preferably formed by a moulding process and in conforming to said posts 10 is rectangular in cross section and has an appropriate length or height. As noted in FIG. 2, the bottom wall **17*b* of said sleeve is somewhat thicker than the side walls 17*a*** thereof to prevent or avoid any damage or rupture of the bottom wall when inserted under some pressure into its hole.

The posts generally used are on the order of 2×6 or 2×8 inches in transverse dimension. In proceeding with the construction of the structure, the posts after being positioned are trimmed off to all be of an equal height.

The sleeve provides a positive barrier between the post bottom **10*a* and the ground 16 thereabout whereby there is no deterioration of the sunken post portion due to the ground contact. As shown the sleeve may extend about the post above the floor or ground level as at 17*c*** but may be trimmed to floor level if desired.

Figure 4:
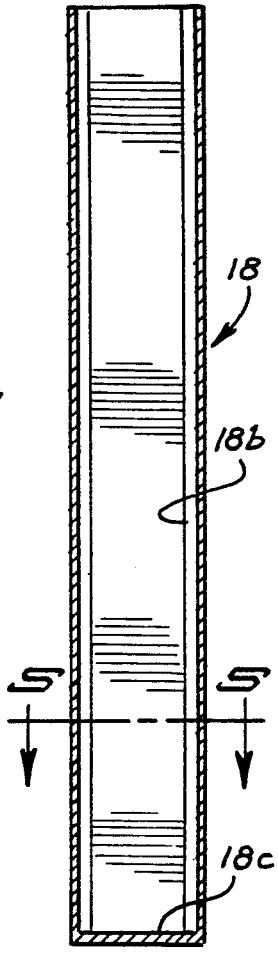
FIG. 4 is a view similar to that of FIG. 4 showing a modification.
Figure 3:
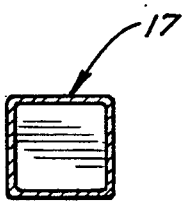
FIG. 3 is a view in cross section taken on line 3—3 of FIG. 2 as indicated.
Figure 5:
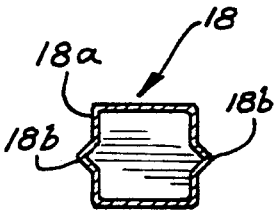
FIG. 5 is a view in cross section taken on line 5—5 of FIG. 4 as indicated.

In FIGS. 4–5, a modification of said sleeve 17 is shown in sleeve 18 wherein the modification consists of vertical projecting vent **18*b*, V-shaped vents shown in horizontal section in FIG. 5 at the two opposed sides 18*a* of said sleeve. The bottom wall is 18*c***.

Said vents provide for the escape or exhaust of any air which might otherwise become trapped between said bottom **10*a* of said post and the bottom 18*c*** of said sleeve.

Said vents also provide for expansion to accommodate or fit posts of somewhat varying tolerances.

Thus, it is seen that I have provided a long lasting complete barrier against any engagement between the post and its portion adjacent to or beneath the ground surface from any contact with the ground and said sleeve is impervious to any adverse action of the ground affecting said sleeve whereby said post is fully protected against the adverse effects of ground contact.

It will of course be understood that various changes may be made in the form, details, arrangement and proportions of the product without departing from the scope of the invention, which generally stated, consists in a device capable of carrying out the objects above set forth, such as disclosed and defined in the appended claims.

What is claimed is:

1. A barrier against the adverse effects of ground contact on the ground insert portion of a sheltered post to support a frame structure comprising, a sleeve receiving therein the lower ground insert portion of a sheltered post, a bottom wall of said sleeve retaining said post therein, said sleeve being formed of a dense synthetic material impervious to the adverse effects resulting from ground contact, said material having a long lasting serviceable existence, said sleeve having a rectangular cross-sectional dimension compatible with that of a post extended therein providing a close contact sliding fit its full height with the walls of the post therein, a vent v-shaped in cross section extending the full height of said sleeve being open at the top thereof to provide transverse expansion to accommodate a snug fitting post and to provide for the escape of air underlying the bottom of said post, and said sleeve having a uniform side wall and thickness throughout the full extent thereof.

* * * * *